US009235158B2

(12) United States Patent
Ishida

(10) Patent No.: US 9,235,158 B2
(45) Date of Patent: Jan. 12, 2016

(54) DEVELOPING DEVICE

(71) Applicant: CANON KABUSHIKI KAISHA, Tokyo (JP)

(72) Inventor: Yusuke Ishida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/632,298

(22) Filed: Feb. 26, 2015

(65) Prior Publication Data

US 2015/0253690 A1 Sep. 10, 2015

(30) Foreign Application Priority Data

Mar. 5, 2014 (JP) ..... 2014-042483

(51) Int. Cl.
*G03G 15/09* (2006.01)
*G03G 15/08* (2006.01)

(52) U.S. Cl.
CPC ..... *G03G 15/0812* (2013.01); *G03G 15/09* (2013.01)

(58) Field of Classification Search
CPC ..... G03G 15/0812; G03G 15/09
USPC ..... 399/274–277
See application file for complete search history.

(56) References Cited

U.S. PATENT DOCUMENTS 6,480,691 B2 * 11/2002 Okada ..... 399/276
7,769,327 B2 * 8/2010 Morimoto et al. ..... 399/276
9,002,242 B2 4/2015 Ishida

FOREIGN PATENT DOCUMENTS

JP H05-040399 A 2/1993
JP H11-024407 A 1/1999

OTHER PUBLICATIONS

Yusuke Ishida et al., U.S. Appl. No. 14/631,894, filed Feb. 26, 2015.

* cited by examiner

*Primary Examiner* — Hoang Ngo
(74) *Attorney, Agent, or Firm* — Fitzpatrick, Cella, Harper & Scinto

(57) ABSTRACT

A developing device includes a developing sleeve having a plurality of grooves, and a magnetic field generating portion configured to be disposed on an inner side of the developing sleeve and including at least a drawing-up pole and a cut pole. The magnetic field generating portion is configured to form. a Fr attenuation area and a Fθ reverse area between a peak of a magnetic flux density of the drawing-up pole and a peak of a magnetic flux density of the cut pole. Fr attenuates toward the cut pole side from the drawing-up pole side in the Fr attenuation area and Fθ is oriented towards an opposite direction to a direction of rotation of the developing sleeve in the Fθ reverse area. A pitch interval of the plurality of grooves is shorter than a length of the Fθ reverse area in the direction of rotation of the developing sleeve.

8 Claims, 10 Drawing Sheets

DEVELOPING DEVICE

BACKGROUND OF THE INVENTION

1. Field of the Invention

This disclosure relates to a developing device which develops an electrostatic latent image formed on an image carrier, such as a photoconductive drum, by using a developer including a non-magnetic toner and a magnetic carrier.

2. Description of the Related Art

In an image forming apparatus, such as a copying machine, a printer, or a facsimile machine, which is an electro-photographic type or an electrostatic recording type, and a multi-purpose peripheral which has a plurality of functions of these apparatuses, visualization (developing) is performed by adhering the developer to an electrostatic latent image which is formed on the image carrier, such as a photoconductive drum. In the developing device which is used in such developing, in the related art, a technology of using a two-component developer (hereinafter, referred to as a developer) which is made of a toner having non-magnetic particles and a carrier having magnetic particles, is known.

In such a developing device, the developer is carried on an outer surface of a developing sleeve which has a magnet disposed on an inner side, and the developer is conveyed by rotation of the developing sleeve. The amount (thickness of a layer) of the developer is regulated by a regulating blade which is disposed in the vicinity of the developing sleeve, and the developer is conveyed to a developing area which opposes the photoconductive drum. Then, the electrostatic latent image which is formed on the photoconductive drum is developed by the toner in the developer.

As the developing sleeve which carries and conveys the developer in this manner, for example, JP-A-5-40399 discloses a developing sleeve which has a plurality of grooves on an outer surface thereof. In this configuration, it is possible to capture the developer with the plurality of grooves provided on the outer surface, and to convey the developer with high efficiency.

Meanwhile, in general, a magnet which is disposed on an inner side of the developing sleeve includes a drawing-up pole which draws up and carries the developer in a developing container by the developing sleeve, and a cut pole which is disposed to be adjacent to the drawing-up pole and to be in the vicinity of the regulating blade. The developer which is drawn up by the drawing-up pole is conveyed to the cut pole by the rotation of the developing sleeve, and the thickness of the layer is regulated by the regulating blade. However, at this time, a shear (compression) is applied from the drawing-up pole to the vicinity of the cut pole in the vicinity of the developing sleeve. When the developer receives the compression over a long period of time, there is a possibility that the developer deteriorates, the toner is not uniformly placed with respect to the electrostatic latent image, a uniform transfer is not performed, roughness, such as graininess, is generated on the image, and image density deteriorates. In addition, as the toner is excessively pressed against the developing sleeve, there is a possibility that an uneven density is generated by a hard sticking of the toner with the developing sleeve.

Here, as described in JP-A-11-24407, a configuration in which a drawing-up magnetic pole is provided in the vicinity of the regulating blade and regulation of thickness of the layer of the developer on the developing sleeve is performed by this magnetic pole, is suggested. As the developer is drawn up and the thickness of the layer is regulated by the one magnetic pole, it is possible to reduce the above-described compression of the developer, and to suppress deterioration of the developer.

However, similar to the above-described JP-A-11-24407, when the developer is drawn up and the thickness of the layer is regulated by the one magnetic pole, a magnetic force becomes weak due to a magnet in the vicinity of the developing sleeve. For this reason, there is a possibility that the amount of the developer upstream of the regulating blade becomes unstable, for example, the amount of the developer extremely becomes small. Accordingly, there is a case where the amount of the developer which is carried by the developing sleeve becomes unstable (coating defect of the developer is generated), and uneven image density caused by the coating defect is generated.

SUMMARY OF THE INVENTION

According to an aspect of this disclosure, there is provided a developing device including a developing container configured to store a developer including a non-magnetic toner and a magnetic carrier, a cylindrical developing sleeve having a plurality of grooves which are respectively formed in a direction which intersects a circumferential direction of the developing sleeve on an outer surface thereof and configured to rotate while carrying the developer on the outer surface, a developer regulating member configured to regulate an amount of the developer carried by the developing sleeve, and a magnetic field generating portion disposed on an inner side of the developing sleeve and including a plurality of fixed magnetic poles which has at least a drawing-up pole which draws up the developer in the developing container and bears the developer on the outer surface of the developing sleeve and a cut pole which is disposed to be adjacent to the drawing-up pole on a downstream of the drawing-up pole in a direction of rotation of the developing sleeve and to be in the vicinity of the developer regulating member. The plurality of fixed magnetic poles configured to form a Fr attenuation area in which Fr attenuates toward the cut pole side from the drawing-up pole side between a peak of a magnetic flux density of the drawing-up pole and a peak of a magnetic flux density of the cut pole and a Fθ reverse area in which Fθ is oriented towards an opposite direction to the direction of rotation of the developing sleeve between the peak of a magnetic flux density of the drawing-up pole and the peak of a magnetic flux density of the cut pole where Fr is a magnetic force in a direction toward the center of the developing sleeve and Fθ is a magnetic force in a tangential direction of the outer surface of the developing sleeve. A pitch interval of the plurality of grooves of the developing sleeve is shorter than a length of the Fθ reverse area in the direction of rotation of the developing sleeve.

Further features of the present invention will become apparent from the following description of exemplary embodiments with reference to the attached drawings. The accompanying drawings, which are incorporated in and constitute apart of the specification, illustrate exemplary embodiments, features, and aspects of the invention and, together with the description, serve to explain the principles of the invention.

DESCRIPTION OF THE EMBODIMENTS

First Embodiment

Figure 1:
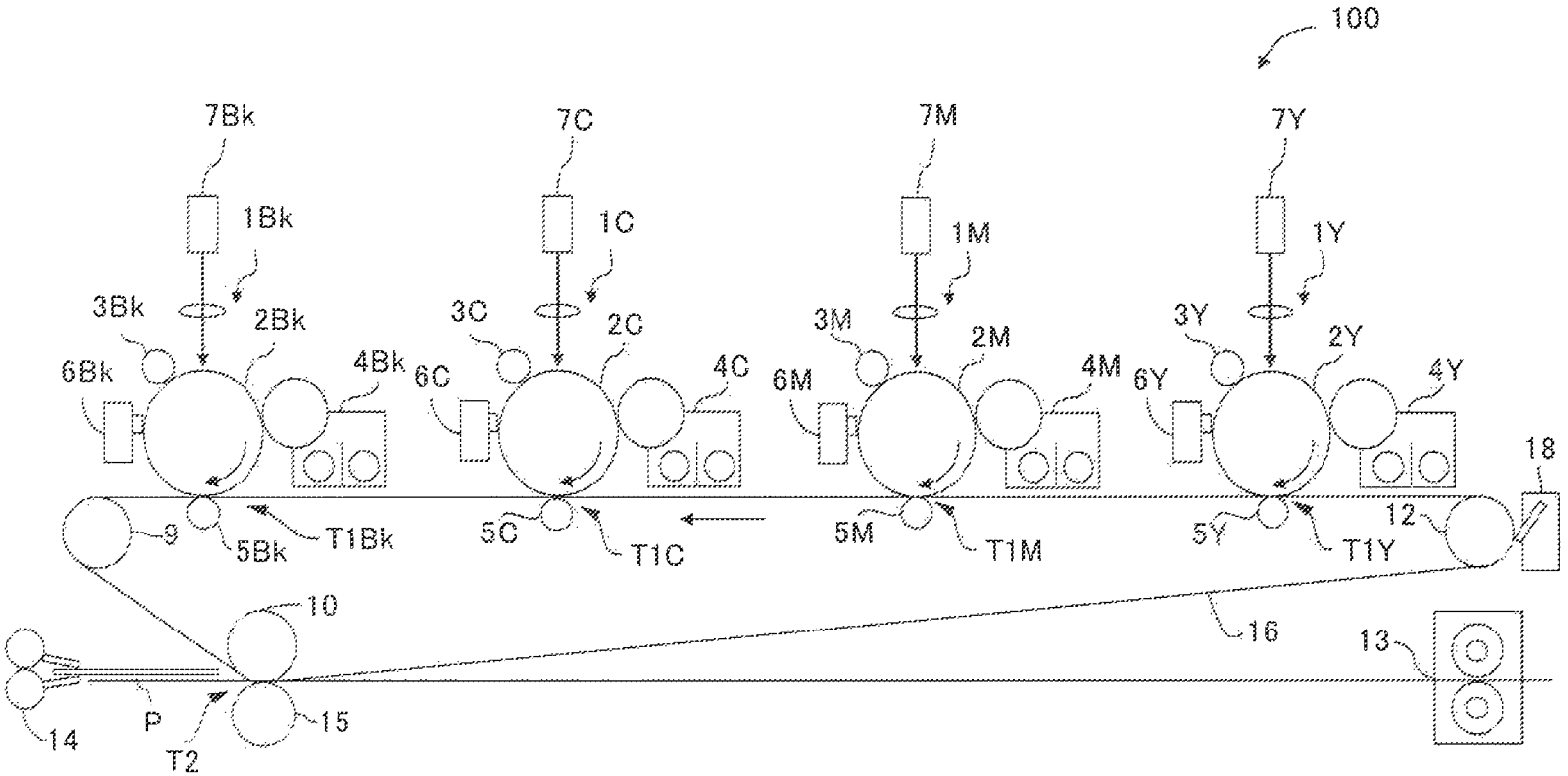
FIG. 1 is a schematic configuration view of an image forming apparatus according to a first embodiment of this disclosure.

A first embodiment of this disclosure will be described with reference to FIGS. 1 to 7. First, a schematic configuration of an image forming apparatus which includes a developing device of the embodiment will be described with reference to FIG. 1.

[Image Forming Apparatus]

An image forming apparatus 100 is an electro-photographic full-color printer which includes four image forming portions 1Y, 1M, 1C, and 1Bk that are provided corresponding to four colors, such as yellow, magenta, cyan, and black. The image forming apparatus 100 forms a toner image (image) on a recording medium P corresponding to an image signal from a host device, such as a scanning apparatus (not illustrated) which is connected to a body of the image forming apparatus, or a personal computer, which is connected so as to be able to communicate with the body of the image forming apparatus. Examples of the recording medium include a sheet material, such as a paper sheet, a plastic film, or a piece of cloth. To schematically describe such an image formation process, first, in each image forming portion 1Y, 1M, 1C, and 1Bk, the toner images having of color are respectively formed on photoconductive drums (electro-photographic photoconductive members) 2Y, 2M, 2C, and 2Bk which function as image carriers. The toner images of each color which are formed in this manner, are transferred onto an intermediate transfer belt 16, and then, are transferred onto the recording medium P from an intermediate transfer belt 16. The recording medium, on which the toner image is transferred, is conveyed to a fixing unit 13, and the toner image is fixed to the recording medium. Hereinafter, this will be described in detail.

In addition, the four image forming portions 1Y, 1M, 1C, and 1Bk which are provided in the image forming apparatus 100 have substantially the same configuration as each other except that the developing colors are different from each other. Therefore, hereinafter, when it is not particularly necessary to be distinguished, suffixes Y, M, C, and Bk, which are adhered to reference numerals for illustrating constituent elements in any of the image forming portions will be omitted, and the overall description will be described.

In an image forming portion 1, a cylindrical photoconductive member which functions as an image carrier, that is, a photoconductive drum 2, is disposed. The photoconductive drum 2 is rotate-driven in an arrow direction in the drawing. A charging roller 3 which functions as a charging portion, a developing device 4 which functions as a developing portion, a primary transfer roller 5 which functions as a transfer portion, and a cleaning unit 6 which functions as a cleaning portion, are disposed in the periphery of the photoconductive drum 2. A laser scanner (exposing unit) 7, which functions as an exposing portion, is disposed on an upper side of the drawing of the photoconductive drum 2.

In addition, the intermediate transfer belt 16 is disposed to oppose the photoconductive drums 2 of each image forming portion 1. The intermediate transfer belt 16 extends by a drive roller 9, a secondary transfer inner roller 10, and an extension roller 12, and circulates and moves in the arrow direction in the drawing by driving the drive roller 9. At a position which opposes the secondary transfer roller 10 while nipping the intermediate transfer belt 16, a secondary transfer outer roller 15 is disposed, and constitutes a secondary transfer portion T2 which transfers the toner image on the intermediate transfer belt 16 to the recording medium P. The fixing unit 13 is disposed downstream of the secondary transfer portion T2 in a direction of conveyance of the recording medium.

A process of forming full-color images of four colors, for example, by the image forming apparatus 100 which is configured as described above, will be described. First, when an image forming operation is started, an outer surface of the rotating photoconductive drum 2 is charged by the charging roller 3 in the same manner. At this time, a charging bias is applied to the charging roller 3 by a charging bias power supply. Next, the photoconductive drum 2 is exposed by laser light which corresponds to the image signal which is generated from an exposing unit 7. Accordingly, an electrostatic latent image according to the image signal is formed on the photoconductive drum 2. The electrostatic latent image on the photoconductive drum 2 is developed by a toner stored in the developing device 4, and is visualized. In the embodiment, a reverse developing type, in which the toner is adhered to a bright portion potential which is exposed by the laser light, is employed.

The toner image which is formed on the photoconductive drum 2 is primarily transferred to the intermediate transfer belt 16, by a primary transfer portion T1 which is configured between the intermediate transfer belt 16 and the primary transfer roller 5 which is disposed to nip the intermediate transfer belt 16. At this time, a primary transfer bias is applied to the primary transfer roller 5. The toner (residual toner) which remains on the outer surface of the photoconductive drum 2 after the primary transfer, is removed by the cleaning unit 6.

This operation is performed in order in each image forming portion of yellow, magenta, cyan, and black, and the toner images of four colors are superposed on the intermediate transfer belt 16. After this, the recording medium P, which is stored in a recording medium storage cassette (not illustrated) matching the timing with the forming of the toner image, is conveyed by the secondary transfer portion T2 from a supply roller 14. Then, by applying a secondary transfer bias to the secondary transfer outer roller 15, the toner images of four colors on the intermediate transfer belt 16 are secondarily transferred onto the recording medium P all together. The toner which is not completely transferred by the secondary transfer portion T2 and remains on the intermediate transfer belt 16, is removed by an intermediate transfer belt cleaner 18.

Next, the recording medium. P is conveyed to the fixing unit 13 which functions as a fixing portion. By performing heating and pressing by the fixing unit 13, the toner on the recording medium P is melted, mixed, and fixed to the recording medium P as a full-color image. After this, the recording medium P is discharged to the outside of the apparatus. Accordingly, a series of image formation processes is ended. In addition, by using only a desired image forming portion, it is possible to form an image having a desired single color or plural colors.

[Developing Device]

First, the developing device 4 of the embodiment will be described with reference to FIG. 2. In the embodiment, as described above, the configurations of the developing devices of yellow, magenta, cyan, and black are all the same as each other. The developing device 4 includes a developing container 108 which stores a two-component developer (hereinafter, developer) which has non-magnetic toner particles (toner) and magnetic carrier particles (carrier) as main components.

The toner includes coloring resin particles which have a binder resin, a coloring agent, and other additives if necessary, and coloring particles into which an external additive, such as powder made of colloidal silica, is added. It is preferable that the toner is a polyester resin which is manufactured by a polymerization method and is negatively charged, and a volume average particle diameter is 5 μm to 8 μm. In the embodiment, the volume average particle diameter of the toner is 6.2 μm. In addition, as the toner, it is possible to use a toner containing wax which is manufactured by a grinding method, or the like.

As the carrier, it is possible to appropriately use, for example, surface-oxidized or unoxidized iron, nickel, cobalt, manganese, chrome, metal, such as a rare-earth element, an alloy of these materials, or ferrite oxide. In addition, it is also possible to use a resin coat carrier. A manufacturing method of these magnetic particles is not particularly limited. In the carrier, a weight average particle diameter is 20 μm to 50 μm, and is preferably 30 μm to 40 μm. Resistivity is equal to or greater than $10^7$ Ω·cm, and is preferably equal to or greater than $10^8$ Ω·cm. In the embodiment, the resistivity is $10^8$ Ω·cm. In addition, in the embodiment, as a magnetic carrier having a low specific gravity, a resin magnetic carrier which is manufactured by the polymerization method by mixing magnetic metal oxide and non-magnetic metal oxide into a phenolic binder resin at a predetermined ratio is used. In addition, the volume average particle diameter of the carrier is 35 μm, true density is 3.6 g/cm$^3$ to 3.7 g/cm$^3$, and a magnetization amount is 53 A·m$^2$/kg.

The inside of the developing container 108 is divided into a developing chamber 113 and an agitating chamber 114 by a partition 106 which extends in a vertical direction, and an upper portion of the partition 106 is opened. In the developing chamber 113 and the agitating chamber 114, developers are respectively stored, and the developer which is an extra developer in the developing chamber 113 is collected on the agitating chamber 114 side.

In the developing chamber 113 and the agitating chamber 114, a first agitating screw 111 and a second agitating screw 112 are respectively disposed. The first agitating screw 111 agitates and conveys the developer in the developing chamber 113, and the second agitating screw 112 agitates and conveys the developer in the agitating chamber 114. In addition, the toner is replenished from a toner replenish tank (not illustrated) to the upstream side of the agitating chamber 114 in the direction of conveyance of the second agitating screw 112. Then, by the second agitating screw 112, the replenished toner is agitated with the developer already in the agitating chamber 114 and is conveyed, and toner density becomes uniform.

Figure 2:
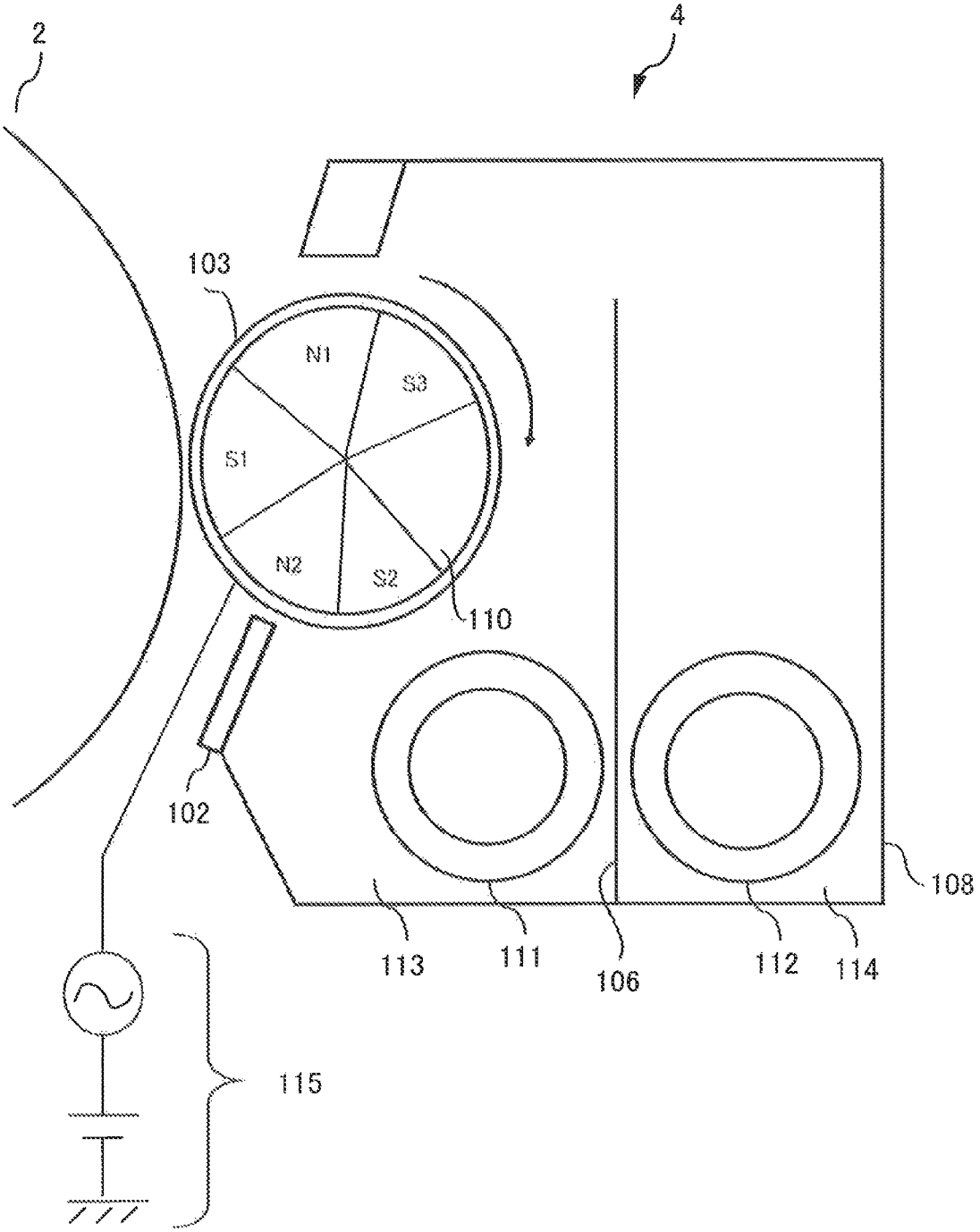
FIG. 2 is a schematic configuration view of a developing device according to the first embodiment.

In end portions (end portions on the upstream side and the downstream side in the direction of conveyance of the first agitating screw) on a near side and a far side in FIG. 2 in the partition 106, developer paths (not illustrated) which mutually communicate with the developing chamber 113 and the agitating chamber 114 are respectively formed. By a conveying force of the first and the second agitating screws 111 and 112, the developer circulates between the developing chamber 113 and the agitating chamber 114. Accordingly, the developer inside the developing chamber 113 in which the toner is consumed by developing and the toner density deteriorates moves into the agitating chamber 114, and the developer which is agitated and conveyed together with the toner replenished in the agitating chamber 114 moves into the developing chamber 113.

A part of the developing chamber 113 which corresponds to an area that faces the photoconductive drum 2 is opened, and a developing sleeve 103 is disposed to be rotatable and to be partially exposed to this opening. The developing sleeve 103 is configured to have a cylindrical shape, for example, by an aluminum alloy, and rotates in an arrow direction in the drawing when a developing operation is performed. In addition, on the inner side of the developing sleeve 103, a magnet 110 which functions as a magnetic field generating portion is disposed to be fixed, and the developing sleeve 103 carries the developer on the outer surface thereof by a magnetic field of the magnet 110, and rotates. In addition, in the periphery of the developing sleeve 103, a regulating blade 102 which functions as a developer regulating member is disposed so that a distal end closely opposes a part of the outer surface of the developing sleeve 103.

Figure 3A:
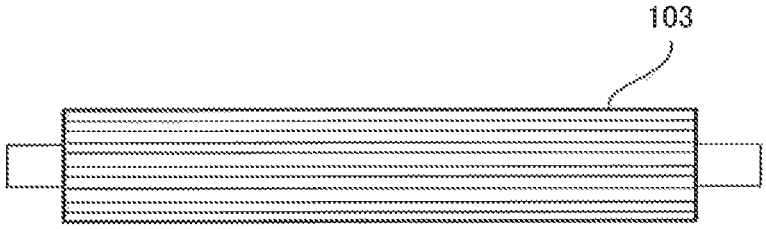
FIG. 3A is a plan view of a developing sleeve according to the first embodiment.
Figure 3B:
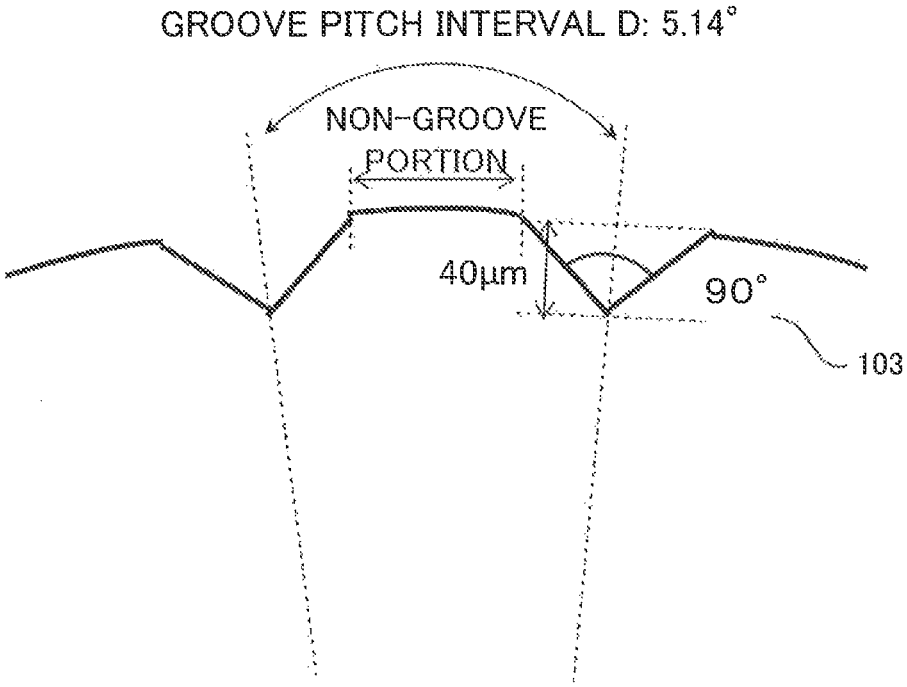
FIG. 3B is a section view illustrating an enlarged groove of the developing sleeve according to the first embodiment.

In the embodiment, as illustrated in FIG. 3A, the developing sleeve 103 is a so-called groove sleeve which has a plurality of grooves that are respectively formed in a direction (parallel to a rotation shaft direction of the developing sleeve 103 in the embodiment) which intersects the circumferential direction on the outer surface. As illustrated in FIG. 3B, the plurality of grooves are respectively formed in a sectional V shape which is orthogonal to the rotation shaft of the developing sleeve 103, and are disposed in the entire circumferential direction with a substantially equivalent interval. In the embodiment, an outer diameter of the developing sleeve 103 is 20 mm, a depth of each groove is 40 μm, an angle which is made of side surfaces of the grooves is 90°, and the number of grooves is 70. In addition, when an angle (interval) which is made of lines that link each of the deepest portions (center) on bottom surfaces of adjacent grooves and the center of the developing sleeve is a groove pitch interval D, the groove pitch interval D is 5.14°. Therefore, as illustrated in FIG. 3B, between the adjacent grooves, a non-groove portion which has a cylindrical surface shape at a part where the grooves are not formed, exists. It is noted that the depth of each of the plurality of grooves is set such that the carrier particles are held by entering into the groove. Thus, in the present embodiment, a depth of each of the plurality of grooves is formed to be equal to or greater than a diameter of the particle of the magnetic carrier and a width of each of the plurality of grooves is formed to be equal to or greater than the diameter of the particle of the magnetic carrier.

The regulating blade 102 regulates an amount (thickness of a layer) of the developer, which is carried and conveyed by the developing sleeve 103. The developer, of which the thickness of the layer is regulated by the regulating blade 102, is conveyed to the developing area which opposes the photoconductive drum 2 while being carried by the developing sleeve 103. Here, in the embodiment, the regulating blade 102 is made of stainless steel. In addition, a predetermined gap is provided between the outer surface (outer surface of a non-grooved portion) of the developing sleeve 103 and the regulating blade 102. In the embodiment, this gap is 300 μm.

Figure 4:
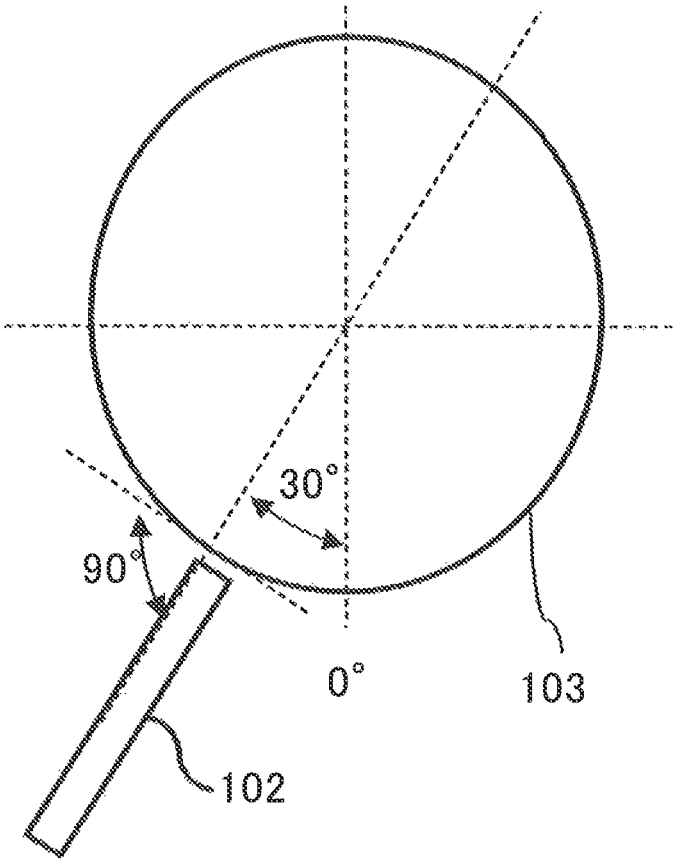
FIG. 4 is a schematic view of a relationship between the developing sleeve and a regulating blade according to the first embodiment.

In addition, an opposing position of the regulating blade 102 with respect to the developing sleeve 103 is as illustrated in FIG. 4. In other words, an angle, which is made of a line that links the lowest point of the developing sleeve 103 in a direction of gravitational force and a center point of the developing sleeve 103, and a line that links the closest point of the regulating blade 102 with respect to the developing sleeve 103 and a center point of the developing sleeve 103, is 30°. In addition, the regulating blade 102 is disposed so that an angle with respect to a tangent of the outer surface of the developing sleeve 103 is 90°.

The magnet 110 has a plurality of fixed magnetic poles. For example, the magnet 110 is configured by assembling a plurality of magnet pieces, and as illustrated in FIG. 2, the magnet 110 is magnetized so that the plurality of magnet poles, S1, S2, S3, N1, and N2, is disposed in a circumferential direction. Here, the S2 pole which is the closest to the first agitating screw 111 is a drawing-up pole which draws up the developer in the developing container (in the developing chamber 113) and bears (holds) the developer on the outer surface of the developing sleeve 103. The N2 pole which is adjacent to the drawing-up pole (S2) on the downstream side, in the direction of rotation of the developing sleeve 103, of the drawing-up pole (S2), is a cut pole which is disposed in the vicinity (vicinity of the developer regulating member) of the regulating blade 102. The S1 pole which is adjacent to the cut pole (N2) on the downstream side, in the direction of rotation of the developing sleeve 103, of the cut pole (N2), is a developing pole which opposes the photoconductive drum 2. Downstream of the developing pole (S1) in the direction of rotation of the developing sleeve 103, the N1 pole and the S3 pole are disposed along the direction of rotation of the developing sleeve 103 in order from the upstream side. As the S3 pole nips an area having low magnetic flux density and is adjacent to the S2 pole, a repulsive pole (peeling pole) which peels off the developer from the outer surface of the developing sleeve 103 is provided.

In the embodiment, as the plurality of magnetic poles is disposed (configured of five poles) along the direction of rotation of the developing sleeve 103 in this manner, the developer in the developing container is carried and conveyed by the developing sleeve 103. In other words, as the developer is agitated and conveyed by the first and the second agitating screws 111 and 112, the developing device 4 charges each of the toner and the carrier. Then, the developer is held by a magnetic force of the magnetic pole (drawing-up pole) S2 for conveyance in order to draw up the developer, and is conveyed by the rotation of the developing sleeve 103. In order to keep the stabilized developer, the developer is sufficiently held by the magnetic pole (cut pole) N2 for conveyance having magnetic flux density over a certain level, forms a magnetic brush, and is conveyed. Next, the amount (thickness of the layer) of the developer is appropriately set by ear-cutting the magnetic brush by the regulating blade 102.

Then, a developing bias which is superposed by a direct current and an alternating electric field is applied to the developing sleeve 103 via a power supply 115 which is provided on the image forming apparatus body side at the developing pole S1. Accordingly, the toner on the developing sleeve 103 is moved to the electrostatic latent image side of the photoconductive drum 2, and the electrostatic latent image is developed as the toner image. In addition, the developing bias is a bias in which an AC voltage is superposed with a DC voltage, and in the embodiment, a rectangular wave of the AC voltage having 10 kHz of frequency and 1000 V of amplitude, is used. The developer which finishes developing is conveyed to the peeling magnetic pole S3 via the taking-in magnetic pole N1, and is taken into the developing container by the peeling magnetic pole S3.

[Magnetic Force and Groove Pitch Interval of Magnet]

Figure 5:
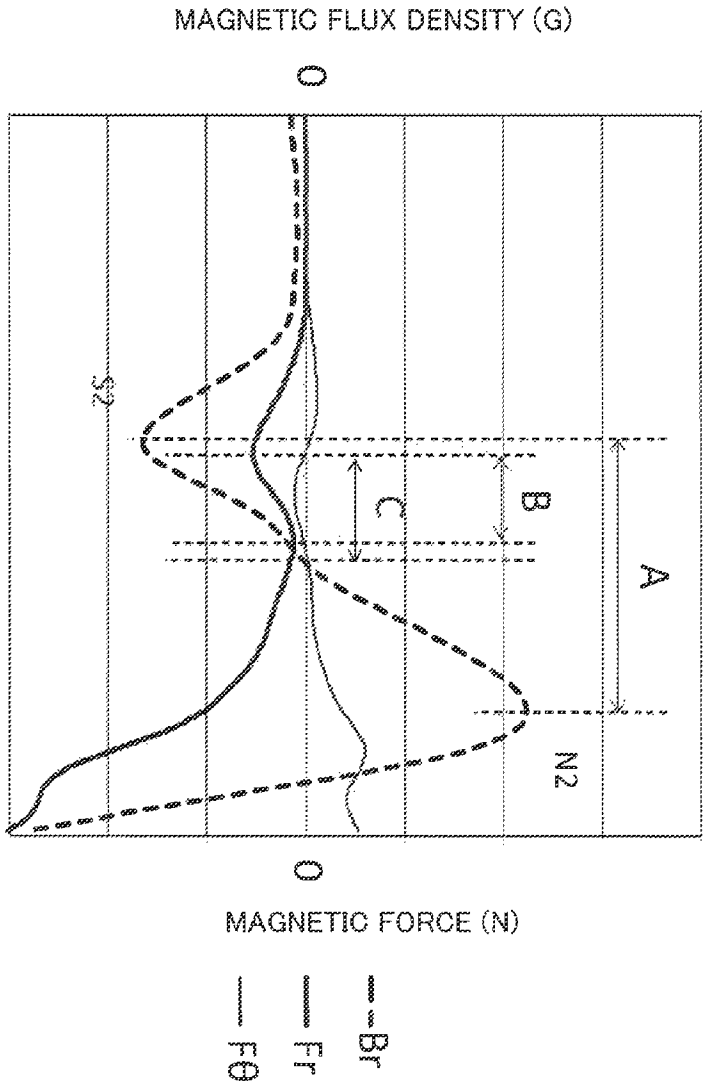
FIG. 5 is a view illustrating magnetic flux density and a magnetic force in the vicinity of a drawing-up pole (S2) and a cut pole (N2) of a magnet according to the first embodiment.

Here, the magnetic force of the magnet 110 having a plurality of magnetic poles as described above, will be described with reference to FIG. 5. FIG. 5 illustrates the magnetic flux density and the magnetic force of the outer surface of the developing sleeve in the vicinity of the S2 and the N2 poles. In addition, in the embodiment, the magnetic force on the outer surface of the developing sleeve 103 in a normal line direction is Fr (thick line), the magnetic force in a tangential direction is Fθ (thin line), and the magnetic flux density in the normal line direction is Br (dashed line). In addition, regarding Fr in FIG. 5, a magnetic force toward the outside from the center of the developing sleeve 103 is a positive magnetic force, and a magnetic force toward the center of the developing sleeve 103 is a negative magnetic force. However, hereinafter, as a force toward the center of the developing sleeve 103, Fr is basically considered. Therefore, for example, an expression that Fr attenuates means that the force toward the center of the developing sleeve 103 attenuates. In addition, regarding Fθ, a magnetic force oriented toward the same direction with the direction of rotation of the developing sleeve 103 is a positive magnetic force, and a magnetic force oriented toward an opposite direction is a negative magnetic force.

In order to stabilize a coating amount (an amount carried by the developing sleeve 103) of the developer, it is necessary to increase the magnetic flux density of the cut pole (N2) to a certain level, and in general, it is preferable that an absolute value is approximately 350 G to 800 G. The absolute value in the embodiment is 550 G. The magnetic flux density of the drawing-up pole (S2) may be at least high for drawing up the developer from the developing chamber 113, and in general, it is preferable that the absolute value is approximately 150 G to 700 G. The absolute value in the embodiment is 300 G. In other words, the magnetic flux density of the cut pole is larger than the magnetic flux density of the drawing-up pole. In addition, the level of the magnetic flux density is arbitrarily set by the configuration of the developing device.

Meanwhile, in a configuration in which two poles, such as the drawing-up pole and the cut pole, are provided, it is considered that deterioration of the developer is reduced by lowering the magnetic force of the drawing-up pole and the cut pole. However, when the magnetic force of the drawing-up pole and the cut pole is simply lowered, the amount of the developer upstream of the regulating blade becomes excessively small, and uneven image density caused by the coating defect of the developer is likely to be generated. In the embodiment, Fr and Fθ are as follows, in an area (area of A in FIG. 5) from a peak of the magnetic flux density of the drawing-up pole, to a peak of magnetic flux density of the cut pole. In other words, when an Fr attenuation area (area of B in FIG. 5) in which Fr attenuates toward the cut pole side from the drawing-up pole side is provided, at the same time, an Fθ reverse area (area of C in FIG. 5) in which Fθ is oriented towards the opposite direction of the direction of rotation of the developing sleeve 103 is provided. That is, the plurality of fixed magnetic poles is configured to form the Fr attenuation area and Fθ reverse area between a peak of a magnetic flux density of the drawing-up pole and a peak of a magnetic flux density of the cut pole. In particular, the Fr attenuation area is provided in the vicinity of the drawing-up pole.

In other words, since the peeling pole exists upstream of the drawing-up pole in the direction of rotation of the developing sleeve 103, Fr gradually increases toward the drawing-up pole from a state where the magnetic force is substantially zero. In the embodiment, the Fr attenuation area in which Fr which tends to ascend attenuates in the middle of flowing (moving) toward the cut pole from the drawing-up pole, is provided. Accordingly, the level of Fr in this area can decrease compared to a case where Fr keeps ascending. In the embodiment, a numerical value range of Fr is from $1\times10^{-8}$ (N) to $1.5\times10^{-7}$ (N). That is, an absolute value of Fr between the peak of the magnetic flux density of the drawing-up pole and the peak of the magnetic flux density of the cut pole is set within a range of $1\times10^{-8}$ (N) to $1.5\times10^{-7}$ (N). When Fr is less than $1\times10^{-8}$ (N), the developer is not efficiently conveyed. In addition, when Fr is greater than $1.5\times10^{-7}$ (N), it is not possible to sufficiently suppress deterioration of the developer. In addition, in an area following the Fr attenuation area, Fr keeps gradually ascending again. In addition, regarding Fθ, the magnetic force is generated in the same direction as the direction of rotation of the developing sleeve 103 toward the drawing-up pole from the state where the magnetic force is substantially zero. However, in the embodiment, the Fθ reverse area in which Fθ is oriented toward the opposite direction of the direction of rotation of the developing sleeve 103 in the middle of moving toward the cut pole from the drawing-up pole, is provided. In addition, in the area following the Fθ reverse area, Fθ is in the same direction as the direction of rotation of the developing sleeve 103 again. In addition, at least a part of the Fr attenuation area and a part of the Fθ reverse area are overlapped with each other.

Setting of the magnetic force is performed by adjusting an absolute value or an inclination of the magnetic flux density Br. Adjustment of Br is performed when the magnet 110 is magnetized. In addition, for example, there is a case where a size or a shape of the plurality of magnet pieces which constitutes the magnet 110 is adjusted.

This will be described in more detail. First, the magnetic force is obtained by the following calculation method. The magnetic force which acts on the carrier is obtained by the following Expression (1). Here, $\mu_o$ is vacuum magnetic permeability, μ is magnetic permeability of the carrier, b is a radius of the carrier, and B is a magnetic flux density.

[Expression 1]

$$\vec{F} = \frac{\mu - \mu_0}{\mu_0(\mu + 2\mu_0)} 2\pi b^2 \nabla B^2 \tag{1}$$

Therefore,

[Expression 2]

$$\vec{F} \propto \nabla B^2 = \frac{\partial}{\partial r}(Br^2 + B\theta^2)\vec{e}_r + \frac{1}{r}\frac{\partial}{\partial\theta(B_r^2 + B_\theta^2)}\vec{e}_\theta \therefore \tag{2}$$

$$\vec{F} \propto \underbrace{\left(B_r\frac{\partial B_r}{\partial r} + B_\theta\frac{\partial B_\theta}{\partial r}\right)\vec{e}_r}_{Fr} + \frac{1}{r}\underbrace{\left(B_r\frac{\partial B_r}{\partial \theta} + B_\theta\frac{\partial B_\theta}{\partial \theta}\right)\vec{e}_\theta}_{F\theta}$$

It is noted that, Br is magnetic flux density of the outer surface of the developing sleeve 103 in the normal line direction, and Bθ is magnetic flux density in the tangential direction.

From Expression (2), if Br and Bθ are obtained, it is possible to obtain Fr and Fθ. Here, the magnetic flux density Br is measured by setting a distance between a probe which is a member of a measuring instrument and the outer surface of the developing sleeve to be 100 μm, by using the magnetic field measuring instrument "MS-9902" (product name) manufactured by F. W. BELL as a measuring instrument.

Furthermore, Bθ can be obtained as follows. In this expression,

[Expression 3]

$$A_z(R, \theta) = \int_\theta^\theta RBr d\theta \tag{3}$$

by using the measured magnetic flux density Br, a vector potential Az(R, θ) at a measurement position of the magnetic flux density Br can be obtained. By solving an equation $\nabla^2 Az(R, \theta)=0$, considering that a boundary condition is Az(R, θ), Az(R, θ) is obtained.

[Expression 4]

$$B_\theta = -\frac{\partial A_z(r, \theta)}{\partial r} \tag{4}$$

Then, by this expression, Bθ can be obtained.

By applying Br and Bθ which are measured and calculated as described above into Expression (1), Fr and Fθ can be derived. Setting of the magnetic force is performed by adjusting an absolute value or the peak position of the magnetic flux density Br of the drawing-up pole or the cut pole.

To describe in detail, regarding the adjustment of the absolute value of the magnetic flux density, it is possible to increase the magnetic force between the drawing-up pole and the cut pole by increasing the magnetic flux density of the drawing-up pole and the cut pole. Conversely, by decreasing the magnetic flux density of the drawing-up pole and the cut pole, it is possible to decrease the magnetic force between the drawing-up pole and the cut pole. In addition, regarding the adjustment of the peak position of the magnetic flux density, as the peak position of the magnetic flux density of the drawing-up pole approaches the cut pole, it is possible to increase the magnetic force between the drawing-up pole and the cut pole. Conversely, as the peak position of the magnetic flux density of the drawing-up pole goes far away from the cut pole, it is possible to decrease the magnetic force between the drawing-up pole and the cut pole.

Based on the above-described point of view, in the embodiment, setting is performed as follows. In other words, as the absolute value of the magnetic flux density of the cut pole decreases with respect to the absolute value of the magnetic flux density of the drawing-up pole, it is possible to set that Fr tends to attenuate toward the cut pole side from the drawing-up pole side, and Fθ tends to become negative. In addition, when the distance between the drawing-up pole and the cut pole widens, it is possible to set that Fr tends to attenuate, and Fθ tends to become negative. The adjustment of the magnetic flux density can realize magnetization conditions (magnetization width, strength, and magnetization position), for example, when the magnet 110 is magnetized, by arbitrarily setting the adjustment. In addition, there is a case where the size or the shape of the plurality of magnet pieces which constitutes the magnet 110 is adjusted.

Figure 6:
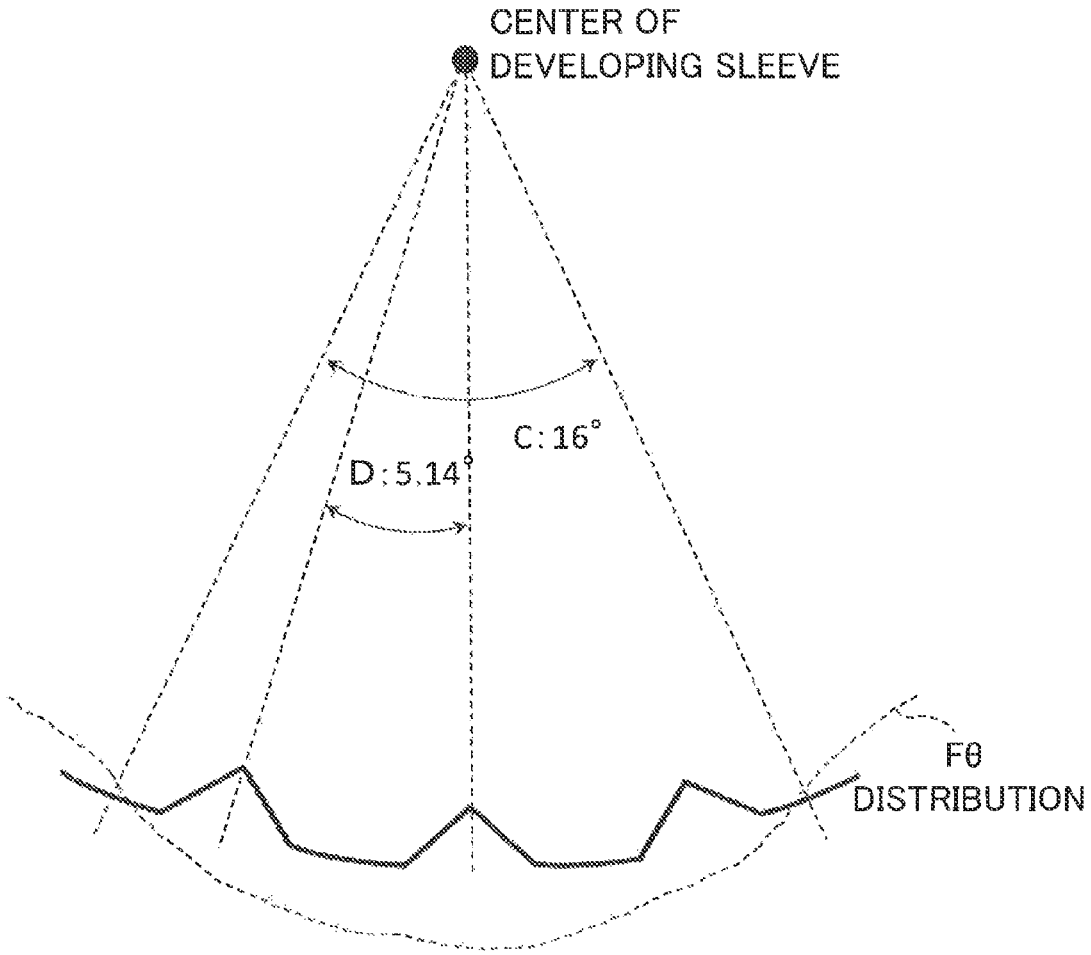
FIG. 6 is a schematic view illustrating a relationship between a pitch interval and Fθ reverse area of the groove of the developing sleeve according to the first embodiment.

In addition, in the embodiment, the pitch interval (groove pitch interval) of the plurality of grooves of the developing sleeve 103 is shorter than a length of the Fθ reverse area in the direction of rotation of the developing sleeve 103. FIG. 6 is a view in which a distribution of Fθ is superposed with respect to a cross-sectional shape of the outer surface of the developing sleeve 103 for illustrating this configuration. In FIG. 6, a range illustrated by an angle C is the Fθ reverse area. In other words, an angle which is made of lines that link both ends of the Fθ reverse area and the center of the developing sleeve 103, is C. In addition, an angle which is made of lines that link the centers of adjacent grooves among the plurality of grooves and the center of the developing sleeve 103, is D. In this case, a relationship between Fθ and the groove pitch interval is regulated to satisfy D<C. In the embodiment, as illustrated in FIG. 6, the Fθ reverse area C is 16°. As described above, since the number of grooves of the developing sleeve 103 is 70, the groove pitch interval D is 5.14°. Therefore, D<C is satisfied.

In the embodiment, regarding the magnetic force from the drawing-up pole to the cut pole, since the Fr attenuation area and the Fθ reverse area are provided together, it is possible to reduce compression of the developer from the drawing-up pole to the cut pole. In other words, since the Fr attenuation area in which Fr attenuates toward the cut pole side from the drawing-up pole side is provided, it is possible to maintain the minimum magnetic force for drawing up and bearing (holding) the developer by the developing sleeve 103, and to reduce shear (compression) which is given to the developer. In addition, since the Fθ reverse area in which Fθ is oriented toward the opposite direction to the direction of rotation of the developing sleeve is provided between the drawing-up pole and the cut pole, an effect of suppressing the amount of the developer which is sent to the cut pole is achieved. As a result, in particular, it is possible to reduce compression of the developer in the vicinity (upstream side of the regulating blade 102 in the direction of rotation of the developing sleeve 103) of the cut pole, and to reduce deterioration of the developer.

In addition, since the developing sleeve 103 is configured to include the plurality of grooves on the outer surface, and the groove pitch interval is shorter than the length of the Fθ reverse area in the direction of rotation of the developing sleeve, it is possible to convey the developer by the developing sleeve 103 with high efficiency. In other words, in a location (non-groove portion) between the grooves, the developer conveying force greatly deteriorates compared to the groove portion. For this reason, if the groove pitch interval is greater than the Fθ reverse area, the conveying amount of the developer by the developing sleeve in the Fθ reverse area decreases, and there is a possibility that uneven image density is generated due to unstable coating of the developer. In contrast, in the embodiment, as the groove pitch interval is smaller than the Fθ reverse area, in a location where the conveying force deteriorates due to the magnetic force in the vicinity of the sleeve, such as the Fθ reverse area, it is also possible to stably convey the developer. Then, it is possible to stabilize the amount (coating amount) of the developer which is carried by the developing sleeve. In other words, it is possible to achieve both the control of deterioration of the developer and coating stabilization of the developer on the developing sleeve. As a result, it is possible to form the stabilized images over a long period of time.

Figure 7:
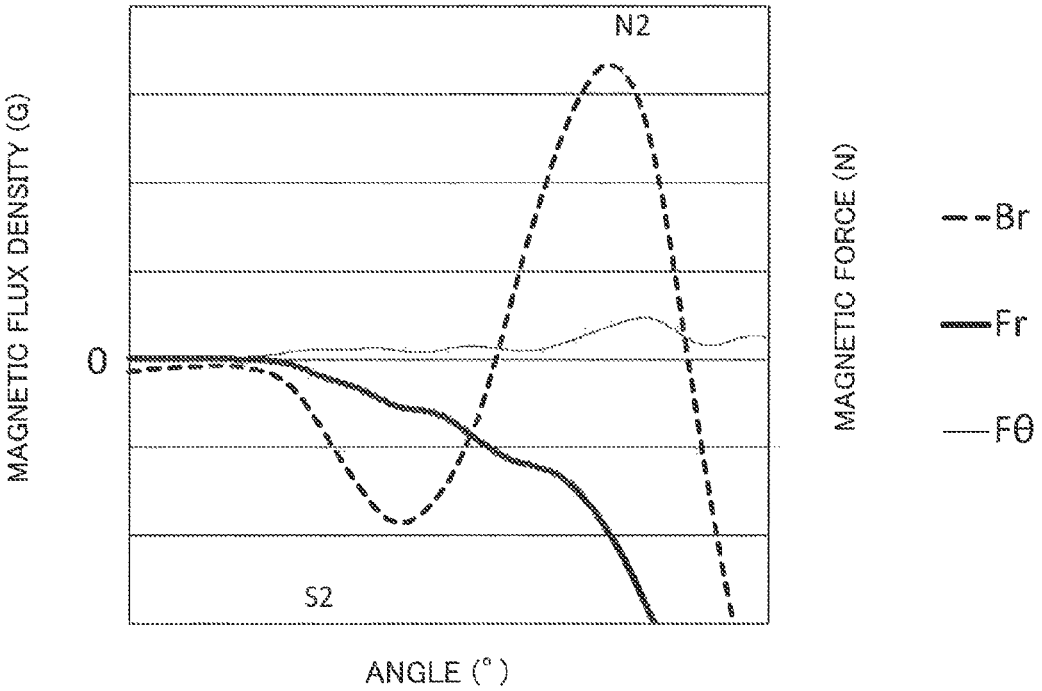
FIG. 7 is a view illustrating magnetic flux density and a magnetic force in the vicinity of the drawing-up pole (S2) and the cut pole (N2) of the magnet according to a Comparative Example.

Here, as illustrated in FIG. 7, a Comparative Example, in which Fr has a magnetic field pattern of monotonic increase, from the drawing-up pole to the cut pole, will be described. In the Comparative Example, compared to the magnetic field pattern of the embodiment illustrated in FIG. 5, since an area in which the developer is strongly pressed against the developing sleeve is widely generated, the developer receives more shear by the magnetic force. In addition, similarly to the Comparative Example, when Fθ is oriented towards the same direction as the direction of rotation of the developing sleeve from the drawing-up pole to the cut pole, the conveying amount of the developer which is sent to the vicinity of the cut pole increases, and the developer in the vicinity of the cut pole receives more shear. As a result, the developer deteriorates as the images are formed for a long period of time, and an image defect, such as roughness of the image or deterioration of image density, is likely to be generated.

Here, an experiment, which is performed with respect to both a case where the magnetic field pattern of the embodiment illustrated in FIG. 5 is provided, and a case where the magnetic field pattern of the Comparative Example illustrated in FIG. 7 is provided, in the image forming apparatus illustrated in FIG. 1, will be described. In the experiment, images were respectively formed with 10% of image duty over a long period of time. In the embodiment, the image defect was not generated even when 100000 images were formed. Meanwhile, in Comparative Example 1, roughness of the image was generated after forming 5000 images, and uneven density was generated due to fusion of the toner to the developing sleeve after forming 30000 images.

In addition, according to the experiment result by the inventor, it is found that it is preferable to satisfy the following conditions in the configuration of the embodiment illustrated in FIG. 5. First, an angle, which is made of a line that links the peak of the magnetic flux density of the drawing-up pole and the center of the developing sleeve, and a line that links the peak of the magnetic flux density of the cut pole and the center of the developing sleeve, is A. An angle, which is made of lines that link both ends of the Fr attenuation area and the center of the developing sleeve, is B. In this case, it is found that it is preferable to satisfy $0.12 \leq B/A < 0.65$.

$0.12 \leq B/A$ is required because, when an area in which Fr attenuates does not exist in a range which is equal to or greater than 0.12 B/A, the effect with respect to deterioration of the developer decreases. Meanwhile, when the area in which Fr attenuates is extremely great (when $B/A \geq 0.65$), the amount of the developer which is conveyed to the cut pole extremely decreases, and unstable coating of the developer is generated. In the embodiment, A=60°, B=12°, and B/A=0.2.

Next, an angle which is made of lines that link both ends of the Fθ reverse area and the center of the developing sleeve, is C. In this case, it is found that it is preferable to satisfy $0.12 \leq C/A < 0.40$. $0.12 \leq C/A$ is required because, when the Fθ reverse area does not exist in a range which is equal to or greater than $0.12 \leq C/A$, the effect with respect to deterioration of the developer decreases. Meanwhile, when the Fθ reverse area is excessively great (when $C/A \geq 0.40$), the amount of the developer which is conveyed to the cut pole excessively decreases, and unstable coating of the developer is generated. In the embodiment, A=60°, C=16°, and C/A=0.267.

Furthermore, an angle which is made of lines that link the centers of adjacent grooves among the plurality of grooves and the center of the developing sleeve, is D. In this case, it is found that it is preferable to satisfy $2.5 \leq C/D < 5.0$. In the Fθ reverse area, when $C/D < 2.5$, the groove part in the Fθ reverse area is not sufficient, and sometimes, there is a case where conveying performance of the developer is not sufficient. This is because, as a result, sometimes, uneven image density is generated due to unstable coating of the developer. Meanwhile, when $C/D \geq 5.0$, as the conveying force of the developing sleeve becomes excessively large, and the amount of the developer conveyed to the cut pole becomes excessively large, sometimes, there is a case where an image defect caused by deterioration of the developer, such as roughness of the image, is generated. Here, when $2.5 \leq C/D < 5.0$ is satisfied, it is possible to suppress deterioration of the developer while ensuring conveying performance of the developer. In the embodiment, as illustrated in FIG. 6, C=16°, D=5.14, and C/D=3.11.

In addition, the developing device 4 of the embodiment can be used in the image forming apparatus, such as a copying machine, a printer, or a facsimile, which is an electro-photographic type or an electrostatic recording type, and a multi-purpose peripheral which has a plurality of functions of these apparatuses.

Second Embodiment

Figure 9:
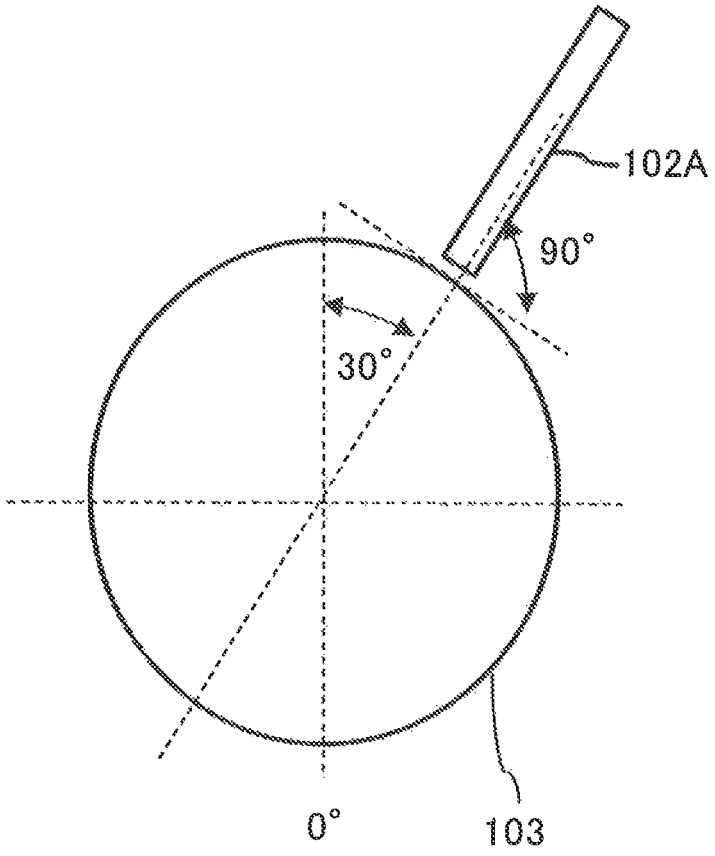
FIG. 9 is a schematic view illustrating a relationship between the developing sleeve and the regulating blade according to the second embodiment.
Figure 10:
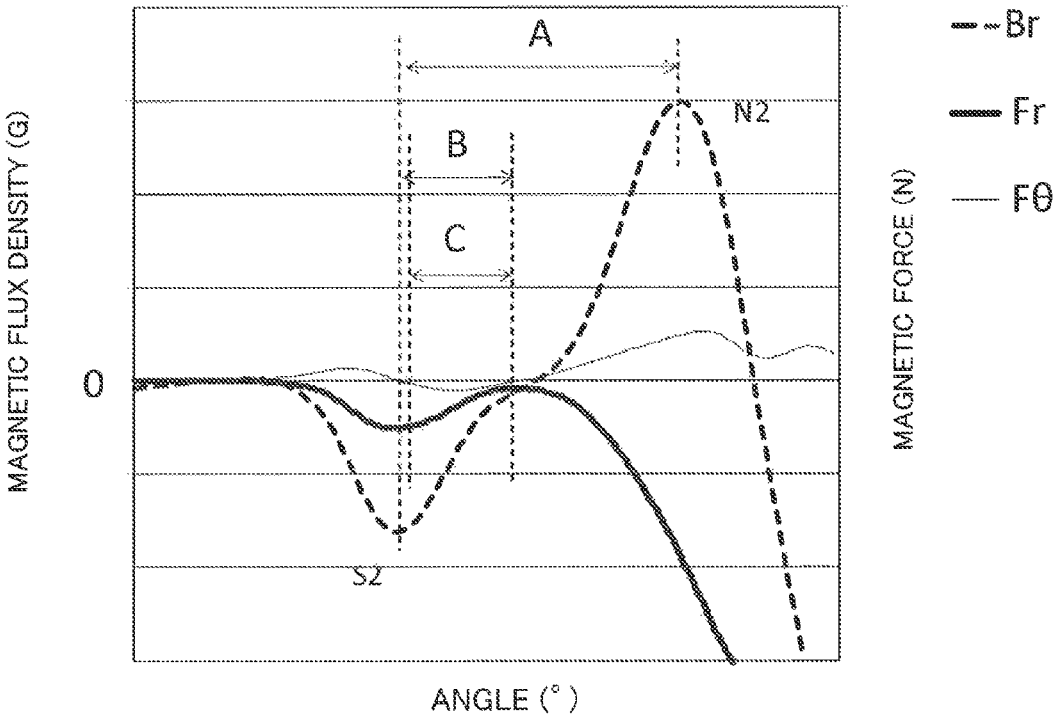
FIG. 10 is a view illustrating magnetic flux density and a magnetic force in the vicinity of the drawing-up pole (S2) and the cut pole (N2) of the magnet according to the second embodiment.

A second embodiment of this disclosure will be described with reference to FIGS. 8 to 10. In the second embodiment, a configuration of the developing device is different from the above-described configuration of the first embodiment. Specifically, in the developing device 4 of the first embodiment, the regulating blade 102 is disposed below a horizontal line which passes the center of the developing sleeve 103. In contrast, in a developing device 4A of the second embodiment, a regulating blade 102A is disposed above the horizontal line which passes the center of developing sleeve 103. According to this, the position of the plurality of magnetic poles of a magnet 110A, which functions as the magnetic field generating portion, is different from that of the magnet 110 of the first embodiment. Since other configurations and operations are similar to those of the first embodiment, hereinafter, the different parts will be mainly described.

Figure 8:
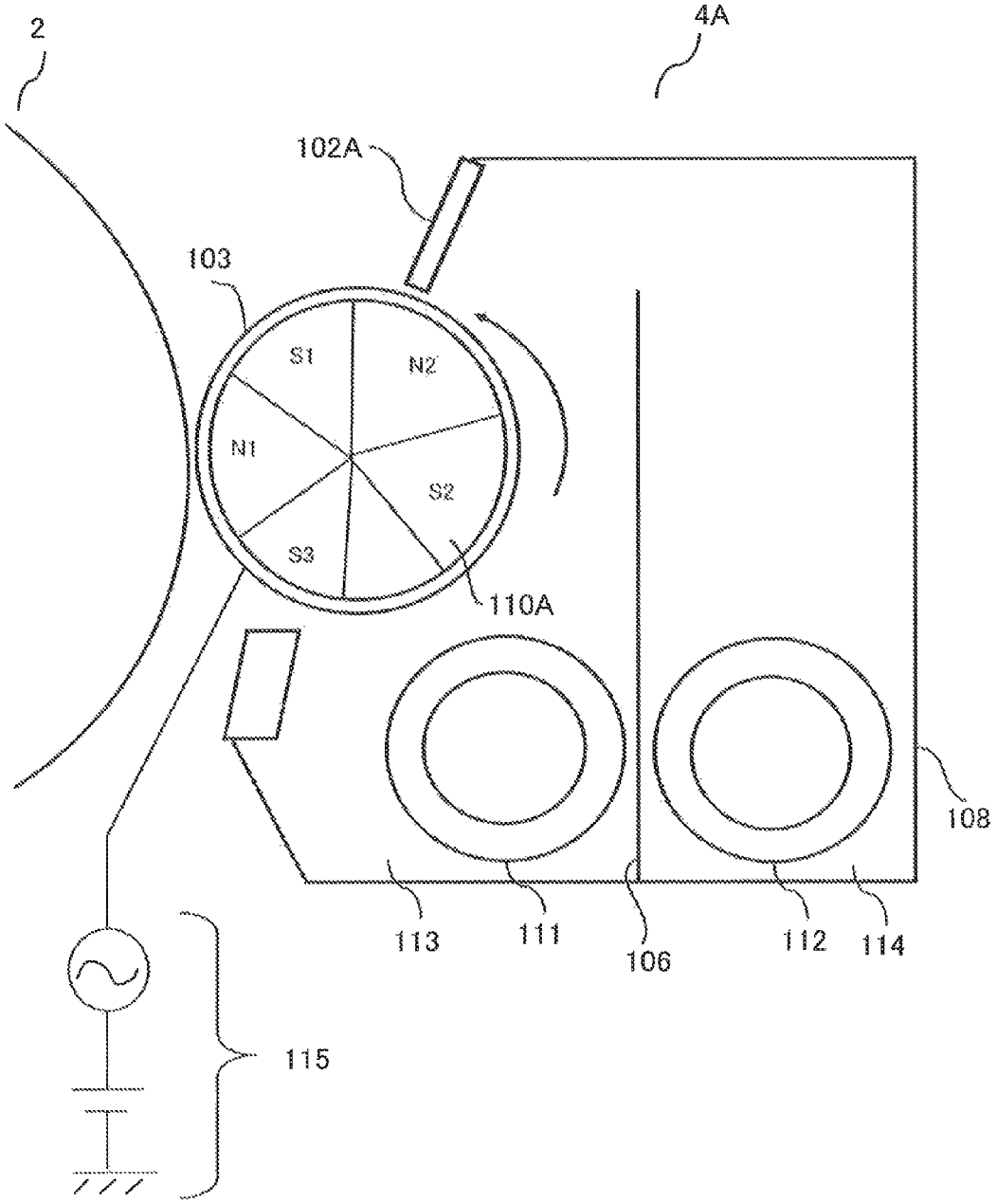
FIG. 8 is a schematic configuration view of a developing device according to a second embodiment of this disclosure.

In the embodiment, the developing sleeve 103 rotates in a direction illustrated by an arrow in FIG. 8. In addition, an opposing position of the regulating blade 102A with respect to the developing sleeve 103 is as illustrated in FIG. 9. In other words, an angle, which is made of a line that links an uppermost point of the developing sleeve 103 in a direction of gravitational force and a center point of the developing sleeve 103, and a line which links the closest point of the regulating blade 102A with respect to the developing sleeve 103 and the center point of the developing sleeve 103, is 30°. In addition, the regulating blade 102A is disposed so that an angle with respect to a tangent of the outer surface of the developing sleeve 103 is 90°.

As illustrated in FIG. 8, the magnet 110A is magnetized so that a plurality of magnetic poles, S1, S2, S3, N1, and N2, is disposed in the circumferential direction. Here, the S2 pole which is the closest to the first agitating screw 111 is a drawing-up pole which draws up the developer in the developing container (in the developing chamber 113) and bears the developer on the outer surface of the developing sleeve 103. The N2 pole which is adjacent to the drawing-up pole (S2) downstream of a direction of rotation of the developing sleeve 103, is a cut pole which is disposed in the vicinity (vicinity of the developer regulating member) of the regulating blade 102. The S1 pole which is adjacent to the cut pole (N2) on the downstream of the cut pole (N2) in the direction of rotation of the developing sleeve 103, is a conveying pole which conveys the developer, and the N1 pole which opposes the photoconductive drum 2 on the downstream of the conveying pole S1 is a developing pole. Downstream of the developing pole (N1) in the direction of rotation of the developing sleeve 103, the S3 pole is disposed. As the S3 pole is adjacent to the S2 pole by interposing an area having low magnetic flux density therebetween, a repulsive pole (peeling pole) which peels off the developer from the outer surface of the developing sleeve 103 is configured.

In this configuration, the developing device 4A carries the developer which is supplied to the outer surface of the developing sleeve 103 by the first and the second agitating screws 111 and 112 on the outer surface of the developing sleeve 103 in a state of being the magnetic brush by a magnetic force of the magnet 110A. Then, the developer is conveyed to a portion (developing area) which opposes the photoconductive drum 2 along with the rotation of the developing sleeve 103, and the amount of the developer which is conveyed to the developing area is appropriately maintained by ear-cutting the magnetic brush by the regulating blade 102A. Furthermore, after passing through the conveying pole S1, a bias voltage which is superposed by the direct current and the alternating electric field is applied to the developing sleeve 103 via a power supply 115 which is provided on the image forming apparatus body side on the developing pole N1. Accordingly, the toner on the developing sleeve 103 is moved to the electrostatic latent image side of the photoconductive drum 2, and the electrostatic latent image is developed as the toner image. Then, the developer which finishes developing is taken into the developing container by the peeling magnetic pole S3.

Here, the magnetic force of the magnet 110A having the plurality of magnetic poles as described above, will be described with reference to FIG. 10. Similarly to the above-described FIG. 5, FIG. 10 illustrates the magnetic flux density and the magnetic force of the outer surface of the developing sleeve in the vicinity of the S2 and the N2 poles. In addition, in the second embodiment, similarly to the first embodiment, in general, it is also preferable that the absolute value of the magnetic flux density of the cut pole (N2) is approximately 350 G to 800 G, and the absolute value of the second embodiment is 550 G. In addition, in general, it is preferable that the absolute value of the magnetic flux density of the drawing-up pole (S2) is 150 G to 700 G, and the absolute value of the second embodiment is 300 G.

In the embodiment, similarly to the first embodiment, Fr and Fθ are also as follows, in an area (area of A in FIG. 10) from a peak of the magnetic flux density of the drawing-up pole, to a peak of magnetic flux density of the cut pole. In other words, when an Fr attenuation area (area of B in FIG. 10) in which Fr attenuates toward the cut pole side from the drawing-up pole side is provided, at the same time, an Fθ reverse area (area of C in FIG. 10) in which Fθ is oriented toward in the opposite direction of the direction of rotation of the developing sleeve 103 is provided. In addition, in the second embodiment, the pitch interval (groove pitch interval) of the plurality of grooves of the developing sleeve 103 is also shorter than a length of the Fθ reverse area in the direction of rotation of the developing sleeve 103. In the second embodiment, the Fθ reverse area C is also 16°. In addition, since the number of grooves of the developing sleeve 103 is 70, the groove pitch interval D is 5.14°.

In this embodiment, similarly to the first embodiment, it is also possible to reduce the shear which is given to the developer in the area from the drawing-up pole to the developing sleeve 103, and to stabilize the conveyance of the developer by the developing sleeve 103. As a result, it is possible to achieve both the control of deterioration of the developer and coating stabilization of the developer on the developing sleeve, and to form the stabilized images over a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-042483, filed Mar. 5, 2014, which is hereby incorporated by reference herein in its entirety.

What is claimed is:

1. A developing device, comprising:

a developing container configured to store a developer including a non-magnetic toner and a magnetic carrier;

a cylindrical developing sleeve having a plurality of grooves which are respectively formed in a direction which intersects a circumferential direction of the developing sleeve on an outer surface thereof and configured to rotate while carrying the developer on the outer surface;

a developer regulating member configured to regulate an amount of the developer carried by the developing sleeve; and a magnetic field generating portion disposed on an inner side of the developing sleeve and including a plurality of fixed magnetic poles which have at least a drawing-up pole which draws up the developer in the developing container and bears the developer on the outer surface of the developing sleeve, and a cut pole which is disposed to be adjacent to the drawing-up pole on a downstream side of the drawing-up pole in a direction of rotation of the developing sleeve and to be in the vicinity of the developer regulating member, wherein the plurality of fixed magnetic poles are configured to form a Fr attenuation area in which Fr attenuates toward the cut pole side from the drawing-up pole side between a peak of a magnetic flux density of the drawing-up pole and a peak of a magnetic flux density of the cut pole, and a Fθ reverse area in which Fθ is oriented towards an opposite direction to the direction of rotation of the developing sleeve between the peak of the magnetic flux density of the drawing-up pole and the peak of the magnetic flux density of the cut pole where Fr is a magnetic force in a direction toward the center of the developing sleeve and Fθ is a magnetic force in a tangential direction of the outer surface of the developing sleeve, wherein a pitch interval of the plurality of grooves of the developing sleeve is shorter than a length of the Fθ reverse area in the direction of rotation of the developing sleeve.

2. The developing device according to claim 1, wherein, when an angle which is made of a line that links the peak of the magnetic flux density of the drawing-up pole and the center of the developing sleeve and a line that links the peak of the magnetic flux density of the cut pole and the center of the developing sleeve is A, and an angle which is made of lines that link both ends of the Fr attenuation area and the center of the developing sleeve is B, $0.12 \leq B/A < 0.65$ is satisfied.

3. The developing device according to claim 2, wherein, when an angle which is made of the lines that link both ends of the Fθ reverse area and the center of the developing sleeve is C, $0.12 \leq C/A < 0.40$ is satisfied.

4. The developing device according to claim 3, wherein, when an angle which is made of lines that link the centers of the adjacent grooves among the plurality of grooves and the center of the developing sleeve is D, $2.5 \leq C/D < 5.0$ is satisfied.

5. The developing device according to claim 1, wherein, when an angle which is made of the line that links the peak of the magnetic flux density of the drawing-up pole and the center of the developing sleeve and the line that links the peak of the magnetic flux density of the cut pole and the center of the developing sleeve is A, and an angle which is made of lines that link both ends of the Fθ reverse area and the center of the developing sleeve is C, $0.12 \leq C/A < 0.40$ is satisfied.

6. The developing device according to claim 1, wherein, when an angle which is made of the lines that link both ends of the Fθ reverse area and the center of the developing sleeve is C, and an angle which is made of lines that link the centers of adjacent grooves among the plurality of grooves and the center of the developing sleeve is D, $2.5 \leq C/D < 5.0$ is satisfied.

7. The developing device according to claim 1, wherein a depth of each of the plurality of grooves is formed to be equal to or greater than a diameter of a particle of the magnetic carrier and a width of each of the plurality of grooves is formed to be equal to or greater than the diameter of the particle of the magnetic carrier.

8. The developing device according to claim 1, wherein an absolute value of Fr between the peak of the magnetic flux density of the drawing-up pole and the peak of the magnetic flux density of the cut pole is set within a range of $1 \times 10^{-8}$ (N) to $1.5 \times 10^{-7}$ (N).

* * * * *